United States Patent [19]

Minich

[11] Patent Number: 4,751,429

[45] Date of Patent: Jun. 14, 1988

[54] HIGH POWER MICROWAVE GENERATOR

[75] Inventor: Roger W. Minich, Patterson, Calif.

[73] Assignee: The United States of America as represented by the United States Department of Energy, Washington, D.C.

[21] Appl. No.: 863,493

[22] Filed: May 15, 1986

[51] Int. Cl.[4] ..... H01J 25/02

[52] U.S. Cl. ..... 315/5; 315/4; 315/39

[58] Field of Search ..... 315/4, 5, 39, 3; 372/2; 331/1.5

[56] References Cited

U.S. PATENT DOCUMENTS

| | | | |
|---|---|---|---|
| 3,700,952 | 10/1972 | Nation | 315/3.5 |
| 3,805,111 | 4/1974 | Ryabinin et al. | 315/39 |
| 4,038,602 | 7/1977 | Friedman | 315/5 |
| 4,080,549 | 3/1978 | Creedon et al. | 313/231.31 |
| 4,122,372 | 10/1978 | Walsh | 315/5 |
| 4,150,340 | 4/1979 | Kapetanakos et al. | 315/3 |
| 4,200,820 | 4/1980 | Symons | 315/4 |
| 4,345,220 | 8/1982 | Sullivan | 315/39 |
| 4,412,150 | 10/1983 | Alexeff | 315/4 |
| 4,495,442 | 1/1985 | Minami | 315/5.29 |
| 4,531,076 | 7/1985 | Holder | 315/4 |
| 4,553,068 | 11/1985 | Brandt | 315/5 |

OTHER PUBLICATIONS

Mahaffey et al., "High Power Microwaves from a Nonisochronic Reflecting Electron System," *Physical Review Letters*, vol. 39, #13, Sep. 77, pp. 843–846.

Langmuir et al., "Electrical Discharges in Gases," *Reviews of Modern Physics*, vol. 3, #2, Apr. '31, pp. 237–239.

Birdsall et al., *Electron Dynamics of Diode Regions*, Academic Press, 1966, pp. 68–81.

Miller, *An Introduction to the Physics of Intensed Charged Particle Beams*, Plenum Press, 1982, pp. 2–12, 42–45.

*Primary Examiner*—David K. Moore

*Attorney, Agent, or Firm*—Gary C. Roth; L. E. Carnahan; Judson R. Hightower

[57] ABSTRACT

A device (10) for producing high-powered and coherent microwaves is described. The device comprises an evacuated, cylindrical, and hollow real cathode (20) that is driven to inwardly field emit relativistic electrons. The electrons pass through an internally disposed cylindrical and substantially electron-transparent cylindrical anode (24), proceed toward a cylindrical electron collector electrode (26), and form a cylindrical virtual cathode (32). Microwaves are produced by spatial and temporal oscillations of the cylindrical virtual cathode (32), and by electrons that reflex back and forth between the cylindrical virtual cathode (32) and the cylindrical real cathode (20).

11 Claims, 2 Drawing Sheets

HIGH POWER MICROWAVE GENERATOR

BACKGROUND OF THE INVENTION

The U.S. Government has rights in this invention pursuant to Contract No. W-7405-ENG-48 between the U.S. Department of Energy and the University of California for the operation of the Lawrence Livermore National Laboratory.

The invention described herein relates generally to method and apparatus for producing microwaves, and more particularly to method and apparatus for producing coherent high-power microwaves.

Microwaves, which may be used for many purposes, occupy the region of the electromagnetic spectrum bounded by radio waves on the long wavelength side and by infrared waves on the short wavelength side. Although there are no sharp boundaries between these regions, microwaves are often considered to have frequencies in the range between about $10^9$ Hz and $3\times10^{11}$ Hz or, equivalently, to have free space wavelengths in the range between about 1 mm and 30 cm.

Low power multi-frequency microwaves can be simply generated as thermal radiation from warm bodies, or as direct incoherent radiation from electrical sparks established across high voltage spark gaps. However, for present day applications, almost all modern microwave generators are electronic devices which produce frequency-tunable, continuous-wave oscillations. These devices include magnetrons, klystrons, and traveling-wave tubes. Magnetrons function when electrons, which are generated from a central axially disposed cylindrical cathode and moving under the combined force of a radial electric field and a externally produced axial magnetic field, interact synchronously with the traveling-wave components of a microwave standing-wave pattern that is provided by an anode consisting of a series of quarter-wavelength cavity resonators symmetrically arranged around the cathode.

Klystrons function by having an axial, velocity-modulated, bunched electron beam pass through an output cavity and transfer energy to the cavity that is subsequently coupled into a microwave transmission line. An external magnetic field parallel to the electron beam axis holds the beam together by overcoming the electrostatic repulsion between electrons.

Traveling-wave tubes function as amplifiers when an axial beam of electrons, retained throughout the length of the tube by focusing means such as an external, longitudinal, fixed magnetic field, interacts continuously and over an appreciable distance with microwaves propagating along a slow-wave circuit.

Additionally, microwaves may be generated by less well known devices, such as the vircator, which functions by having an axial beam of relativistic electrons, emitted from a planar cathode, pass through a planar electron-transparent anode. When the beam current exceeds the space-charge limit, a planar virtual cathode is formed which oscillates at the frequency of the generated microwaves. Discussions related to the operating principles of the vircator may be found in Mahaffey et al, Phys. Rev. Lett. 39, 843 (1977); U.S. Pat. No. 4,150,340 issued Apr. 17, 1979 to Kapetanakos et al; and U.S. Pat. No. 4,345,220 issued Aug. 17, 1982 to Sullivan.

Another microwave producing device is the gyrotron, in which electrons on helical paths interact with an electromagnetic field. Teaching related to the operating principles of the gyrotron is found in U.S. Pat. No. 4,200,820 issued Apr. 29, 1980 to Symons.

Yet other microwave devices utilizing axially directed electron beams are disclosed in U.S. Pat. No. 4,531,076 issued July 23, 1985 to Holder; U.S. Pat. No. 4,122,372 issued Oct. 24, 1978 to Walsh; U.S. Pat. No. 4,038,602 issued July 26, 1977 to Friedman; and U.S. Pat. No. 3,700,952 issued Oct. 24, 1972 to Nation.

Thus, even though there presently exist many different classes of electronic devices capable of producing microwaves at various power levels and efficiencies in view of the importance and extreme variety of microwave technology there remains a continuing need for innovative and structurally simple new classes of device for the production of large quantities of high-powered and coherent microwaves.

SUMMARY OF THE INVENTION

It is therefore an object of the invention to provide a structurally simple new class of device for the production of large quantities of high-powered and coherent microwaves.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention as embodied and broadly described herein, the method and apparatus for producing large quantities of high-powered coherent microwaves of this invention comprises a device having a radially inward cylindrical geometry, as distinguished from the axially linear geometry prevalent in the prior art. The device operates in a vacuum of about $10^{-5}$ Torr or less and comprises a cylindrical and hollow real cathode, of radius $r_c$, that is capable of field emitting relativistic electrons in a generally inward radial direction. Internally and co-axially disposed within the cylindrical real cathode is a cylindrical and substantially electron-transparent anode, of radius $r_a$, preferably comprised of either a wire-mesh or a thin metal foil. The cylindrical real cathode field emits relativistic electrons when the cylindrical anode is rapidly driven preferably in three nanoseconds or less, to a large positive potential of $\phi_a-\phi_c$ with respect to the real cylindrical cathode. This is done by any suitable means, such as by a Blumlein pulse-forming line charged by a Marx voltage generator. A cylindrical electron collector electrode, of radius $r_{col}$, is internally and co-axially disposed within the cylindrical anode. A short circuit path of low, i.e. substantially zero, electrical resistance connects the cylindrical collector electrode and the cylindrical anode so that these two elements share a common electrical potential during the operation of the device. When the physical parameters of the device, and the $\phi_a-\phi_c$ value of the driving high-voltage pulse, are selected to satisfy the inequality $$\alpha\left(\frac{r_a}{r_c}\right)^2\left[\frac{\beta(r_{col}/r_a)}{\beta(r_a/r_c)}\right]^2 > 8,$$

where $\alpha$ is a relativistic correction factor that is a function of $\phi_a - \phi c$, and $\beta$ is the Langmuir beta function, relativistic field emitted electrons from the cylindrical real cathode pass through the cylindrical electron-transparent anode and, when the current reaches the space-charge limit, form a cylindrical virtual cathode. This cylindrical virtual cathode is located between the cylindrical anode and the cylindrical collector electrode. Large quantities of high-powered and coherent microwaves are produced by two mechanisms. First, by the spatial and temporal oscillations of the cylindrical virtual cathode itself. Second, by electrons reflexing back and forth between the cylindrical virtual cathode and the cylindrical real cathode. It is sometimes preferred to arrange that the axial length of the device and the wavelength of the microwaves be approximately equal. Additionally, it is sometimes preferred to add a cylindrical velvet lining to the electron emitting inner surface of the cylindrical real cathode, to aid in the field emission process.

The benefits and advantages of the present invention, as embodied and broadly described herein, include, inter alia, the provision of a structurally simple new class of device for the production of large quantities of high-powered and coherent microwaves.

BRIEF DESCRIPTION OF THE DRAWINGS

The accompanying drawings, which are incorporated in and form a part of the specification, illustrate an embodiment of the invention and, together with the description, serve to explain the principles of the invention. In the drawings.

DETAILED DESCRIPTION OF THE INVENTION

Figure 1:
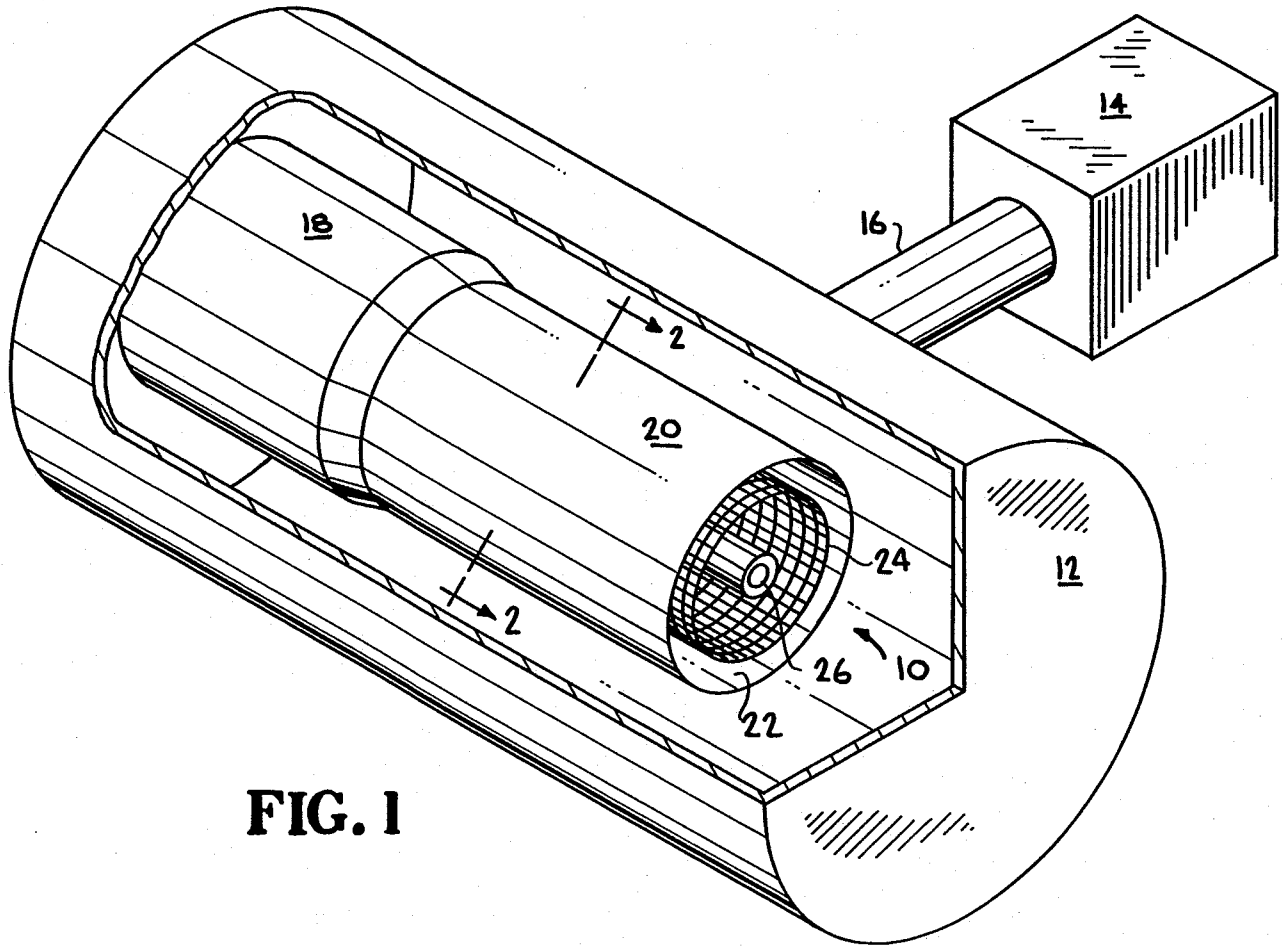
FIG. 1 is cut-away schematic view of a device for producing large quantities of high-powered and coherent microwaves, that is in accordance with the present invention.
Figure 2:
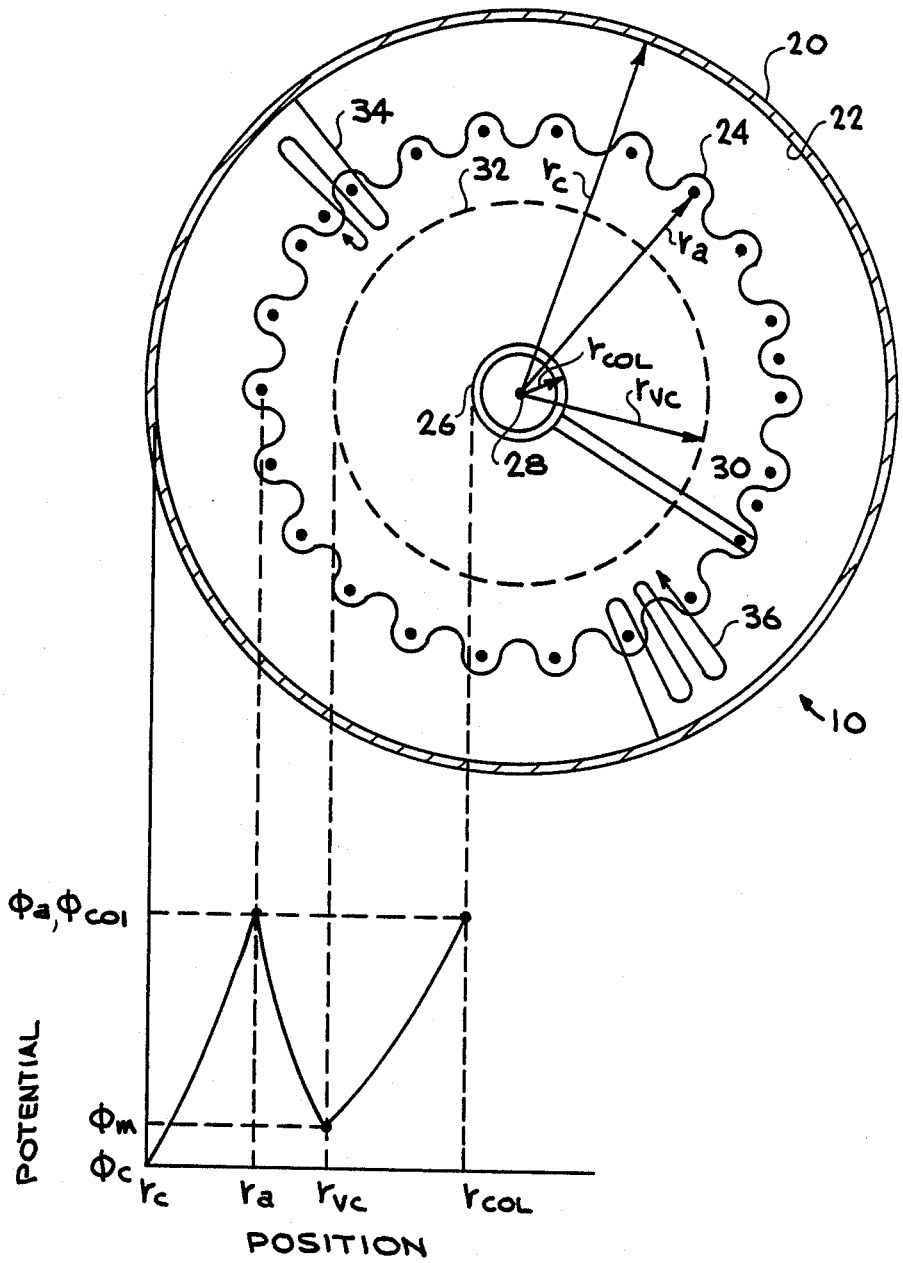
FIG. 2 is a side view and a potential versus position plot within the device of FIG. 1, taken generally along line 2—2 in FIG. 1.

Reference will now be made in detail to the present preferred embodiment of the invention, an example of which is illustrated in the accompanying drawings. Reference is made conjointly to FIGS. 1 and 2 which show, respectively, a cut-away schematic view and a side view of a device, in accordance with the present invention, for producing large quantities of high-powered and coherent microwaves. A device 10 is shown contained within a vacuum tank 12 that is enacuated to a vacuum of about $10^{-5}$ Torr, or less, by means of a vacuum pump 14 that communicates with tank 12 via a vacuum duct 16 as is very well known in the prior art. Tank 12, pump 14 and duct 16 are not shown in FIG. 2. The dimensions of vacuum tank 12 should be large enough to preclude any appreciable electrical interaction with device 10, during the operation of device 10 in accordance with standard and well known engineering practice.

Pulse generator 18, that is schematically shown, is mounted within vacuum tank 12. Pulse generator 18 comprises means for rapidly producing a large voltage, or potential difference, pulse. There are many different types and varieties of high-voltage pulse generators, all very well known in the prior art, that may be used in conjunction with the present invention. For example, pulse generator 18 may preferably comprise a Blumlein pulse-forming line charged by a Marx voltage generator. Pulsed power technology is described at pages 2 to 12 of "An Introduction to the Physics of Intense Charged Particle Beams," by R. B. Miller, published by Plenum Press, New York and London (1982).

Device 10 is comprised of a cylindrical and hollow real cathode 20, that has an inner radius $r_c$ which, in the presently preferred embodiment, is 10 cm. All dimensions and parameters specified herein for the preferred embodiment of device 10 are approximate. The axial length of cylindrical real cathode 20 in the presently preferred embodiment is 6.7 cm. The functional purpose of cylindrical real cathode 20 is to field emit relativistic electrons in a generally inward radial direction. Cylindrical real cathode 20 may be constructed of any common, conducting structural material such as aluminum, copper or stainless steel. The actual thickness of the structural material that comprises cylindrical real cathode 20 may have any convenient value and is not critical to the design of device 10. To aid in the field emission process, cylindrical real cathode 20 may be provided with a cylindrical inner lining, 22, of velvet. Velvet is the generic name of a fabric that is manufactured in a wide range of constructions and weights, is made of silk, rayon, cotton, nylon, or wool, and is characterized by having a short, soft and dense pile. Changing the axial length of cylindrical velvet inner lining 22 can provide a convenient means of changing the effective axial length of the field-emitting inner portion of cylindrical real cathode 20.

Device 10 further comprises a cylindrical and substantially electron-transparent anode 24, of radius $r_a$, that has the value of 8 cm in the presently preferred embodiment, and is of a length equal to the length of cylindrical real cathode 20. In the presently preferred embodiment, cylindrical anode 24 is comprised of an aluminum wire mesh, the wires of which have a diameter of 0.2 mm and a wire center-to-wire center spacing of 1 mm. However, in other embodiments of the invention it is preferred that cylindrical anode 24 be comprised of other varieties of wire mesh, or of thin metal foils, such as approximately 0.01 to 0.03 mm thick aluminum foil.

Additionally, device 10 is comprised of an inner, cylindrical electron collector electrode 26, of outer radius $r_{col}$ that is equal to 1 cm in the preferred embodiment, and of a preferred length equal to the length of cylindrical real cathode 20. Cylindrical electrode 26, which may be hollow, as shown, or solid, may be constructed of any conducting structural material such as aluminum, copper or stainless steel. As shown in FIG. 2, the radii $r_c$, $r_a$, and $r_{col}$ are all commonly centered about and along a device axis 28. Cylindrical electrode 26 and cylindrical anode 24 are electrically connected by a short circuit path of low, substantially zero, electrical resistance, schematically shown as path 30 in FIG. 2, to insure that they will have a common electrical potential during the operation of device 10. As a practical matter it is generally preferred that cylindrical electrode 26 and cylindrical anode 24 be shorted together at a location near to pulse generator 18.

During the operation of device 10, pulse generator 18 rapidly drives cylindrical anode 24 to a positive potential of $\phi_a - \phi_c$ with respect to cylindrical real cathode 20. In the presently preferred embodiment, $\phi_a - \phi_c$ should be approximately equal to 1 MV, with the potential rising to that value in three nanoseconds or less. As shown in the potential versus position plot of FIG. 2, $\phi_c$ may be taken to be the potential of cylindrical cathode 20, and $\phi_a$ may taken to be the potential of cylindrical anode 24. Note that $\phi_a$ is equal to $\phi_{col}$, the potential of cylindrical electron collector 26. The presently preferred values of $r_c$, $r_a$, $r_{col}$ and $\phi_a-\phi_c$, as given herein, have been selected so that cylindrical real cathode 20 will field emit relativistic electrons that pass through substantially electron-transparent cylindrical anode 24 and create a cylindrical virtual cathode 32, generally co-axially disposed between cylindrical anode 24 and cylindrical electrode 26, at the approximate radius $r_{vc}$ from axis 28. A virtual cathode is herein defined as a spatial region, within an electronic device, having a negative electrical potential minimum such that only a portion of the electrons approaching it are transmitted onward, with the remainder being reflected or reflexed therefrom. In the presently preferred embodiment, high-powered and coherent microwaves having the approximate frequency of 4.5 GHz are produced in device 10 by the spatial and temporal oscillations of cylindrical virtual cathode 32, and also by electrons that reflex back and forth between cylindrical virtual cathode 32 and cylindrical real cathode 20 along orbits such as orbits 34 and 36 as shown in FIG. 2. Since cylindrical real cathode 20 and cylindrical virtual cathode 32 are each of large arial extent, large quantities of high-powered and coherent microwaves are produced by device 10. These microwaves may be utilized within vacuum tank 12 or transported for an external use.

The values of $r_c$, $r_a$, $r_{col}$ and $\phi_a-\phi_c$ must be properly selected in order to insure the formation of a cylindrical virtual cathode within the device. The reasons for this are made clear by an analysis of the physics of the device. As well known since the second decade of the present century, largely because of the pioneering research of Langmuir and his colleagues, the electric current that can flow between electrodes in vacuum is limited by space charge. Much of the theory of the space charge limitation of current flow is summarized and presented in the book "Electron Dynamics of Diode Regions" by Birdsall and Bridges, *Academic Press*, New York and London (1966), which is hereby incorporated by reference herein.

In the non-relativistic case, the maximum current density between cylindrical cathode 20 and cylindrical anode 24 of device 10 is limited to $$I_{ca} = \frac{1}{9\pi}\left(\frac{2e}{m}\right)^{\frac{1}{2}} \frac{(\phi_a - \phi_c)^{3/2}}{r_c^2\,[\beta(r_a/r_c)]^2}$$

where $\beta(r_a/r_c)$ is a function of $(r_a/r_c)$ and e and m are the charge and mass, respectively, of the electron. In this case electrons are assumed to leave cathode 20 with negligible velocity. The values of the $\beta$ function, which is herein named the Langmuir beta function, are given in many references, such as in Langmuir and Compton, Reviews of Modern Physics 3, 237 to 257 (1931), which is hereby incorporated by reference herein.

Also in the non-relativistic case, and now assuming monoenergetic stream of injected electrons wherein each electron has the energy given to an electron when, after starting with zero velocity, the electron falls through a potential change of $\phi_a-\phi_c$, the maximum current density between cylindrical anode 24 and cylindrical electrode 26 is limited to $$I_{a,col} = \frac{8}{9\pi}\left(\frac{2e}{m}\right)^{\frac{1}{2}} \frac{(\phi_a - \phi_c)^{3/2}}{r_a^2\,[\beta(r_{col}/r_a)]^2}.$$

As the monoenergetic electron current density rises from zero to this maximum value, the potential minimum, $\phi_m$, in the spatial region between cylindrical anode 24 and cylindrical electrode 26 drops to a minimum value, as shown in the potential versus position plot of FIG. 2. When the injected monoenergetic electron current density attempts to exceed this maximum value, cylindrical virtual cathode 32 forms at the cylindrical radius $r_{vc}$, also as shown in FIG. 2. Microwaves are then produced by device 10 by the physical mechanisms described hereinabove.

The value of the physical parameters of device 10, in the non-relativistic case, must be selected so that $I_{ca}$ is greater than $I_{a,col}$. In the relativistic case, a relativistic correction factor $\alpha$, which is a function of $\phi_a-\phi_c$, must be further included with this inequality. In the non-relativistic case, that is for low to moderate values of $\phi_a-\phi_c$, the value of $\alpha$ is equal to one, or unity. For increasingly higher values of $\phi_a-\phi_c$, $\alpha$ gradually takes on decreasing, but positive, values. In other words, $\alpha I_{ca}$ must be greater than $I_{a,col}$. Thus $$\alpha\left(\frac{r_a}{r_c}\right)^2\left[\frac{\beta(r_{col}/r_a)}{\beta(r_a/r_c)}\right]^2 > 8$$

is the governing inequality that must be satisfied by the values of $r_c$, $r_a$, $r_{col}$ and $\phi_a-\phi_c$ of device 10 in order to insure that the device will function properly and produce coherent microwaves. In the presently preferred embodiment of the invention, as previously set forth, $r_c$ has the value 10 cm, $r_a$ has the value 8 cm, $r_{col}$ has the value 1 cm, and $\phi_a-\phi_c$ has the value 1 MV. These values satisfy the governing inequality. It is particularly pointed out that for $\phi_a-\phi_c$ equal to 1 MV, $\alpha$ has a value that is only slightly less than unity. In general, the values of $\alpha$ may be experimentally or theoretically determined. For example, the current density in the relativistic planar diode is calculated at pages 42 to 45 of "An Introduction to the Physics of Intense Charged Particle Beams," by R. B. Miller, published by Plenum Press, New York and London (1982), which textbook is hereby incorporated by reference herein. According to computer calculations performed at the Lawrence Livermore National Laboratory, it is believed that the presently preferred embodiment of the invention will produce coherent microwaves of frequency 4.5 GHz.

The axial length of device 10 must be long enough to permit the physical formation of a cylindrical virtual cathode. On the other hand, if the axial length of device 10 is very long, strong phase space coupling between radial and axial degrees of freedom will tend to make the microwaves, produced by device 10, become incoherent. It is consequently preferred that the axial length of devices according to the invention be approximately as long as the wavelength of the coherent microwaves produced by the device. Thus the axial length of device 10, in its presently preferred embodiment, should be approximately 6.7 cm, which is the approximate free space wavelength of 4.5 GHz microwaves.

It is thus appreciated that in accordance with the invention as herein described as shown in FIGS. 1 and 2, a structurally simple new class of device for the production of large quantities of high-powered and coherent microwaves is provided.

The foregoing description of a preferred embodiment of the invention has been presented for purposes of illustration and description. It is not intended to be exhaustive or to limit the invention to the precise form disclosed, and many modifications and variations are possible in light of the above teaching. For example, it is presently believed that devices according to the invention, even while not having inner cylindrical electron collector electrodes, such as cylindrical electrode 26, may yet produce coherent microwaves. It is further believed possible to construct coherent microwave producing devices, according to the invention, wherein an inner cylindrical cathode has a radius that is less than that of an outer, electron-transparent cylindrical anode, with the inner cathode emitting relativistic electrons in an outward direction. In this case an outer cylindrical virtual cathode may be formed that is surroundingly disposed about both the cylindrical anode and cathode. The preferred embodiment herein described was chosen in order to best explain the principles of the invention and its practical application to thereby enable other skilled in the art to best utilize the invention in various embodiments and with various modifications as are suited to the particular use contemplated. It is intended that the scope of the invention be defined by the claims appended hereto.

I claim:

1. A device, that operates in a vacuum of about $10^{-5}$ Torr or less, for producing high-powered and coherent microwaves, the device comprising:

a cylindrical and hollow real cathode, of radius $r_c$, for field emitting relativistic electrons in a generally inward radial direction;

a cylindrical and substantially electron-transparent anode, of radius $r_a$, internally and co-axially disposed within said cylindrical real cathode;

a cylindrical electron collector electrode, of radius $r_{col}$, internally co-axially disposed within said cylindrical anode, with said cylindrical electrode and said cylindrical anode connected by a short circuit path of low electrical resistance so that said cylindrical electrode and said cylindrical anode share a common electrical potential during the operation of said device; and means for rapidly driving said cylindrical anode to a positive potential of $\phi_a-\phi_c$ with respect to the potential of said cylindrical real cathode, with the values of $r_c$, $r_a$, $r_{col}$ and $\phi_a-\phi_c$ selected to satisfy the inequality $$\alpha\left(\frac{r_a}{r_c}\right)^2\left[\frac{\beta(r_{col}/r_a)}{\beta(r_a/r_c)}\right]^2 > 8,$$

wherein $\alpha$ is a relativistic correction factor that is a function of $\phi_a-\phi_c$, and $\beta$ is the Langmuir beta function, so that said cylindrical real cathode field emits relativistic electrons that pass through said substantially electron-transparent cylindrical anode and create cylindrical virtual cathode that is generally co-axially disposed between said cylindrical anode and said cylindrical electrode, and so that said high-powered and coherent microwaves are produced by spatial and temporal oscillations of said cylindrical virtual cathode, and by electrons that reflex back and forth between said cylindrical virtual cathode and said cylindrical real cathode.

2. A device for producing high-powered and coherent microwaves, as recited in claim 1, wherein the axial length of said device is approximately equal to the wavelength of the coherent microwaves produced by the device.

3. A device for producing high-powered and coherent microwaves, as recited in claim 1, wherein said driving means is comprised of a Blumlein pulse-forming line charged by a Marx voltage generator.

4. A device for producing high-powered and coherent microwaves, as recited in claim 3, in which said Blumlein pulse-forming line charged by Marx voltage generator provides means for driving said cylindrical anode to a positive potential of a $\phi_a-\phi_c$ with respect to the potential of said cylindrical real cathode, in a time of three nanoseconds or less.

5. A device for producing high-powered and coherent microwaves, as recited in claim 3, further comprising a cylindrical velvet inner lining for said cylindrical real cathode, to aid in the field emission process.

6. A device for producing high-powered and coherent microwaves, as recited in claim 5, in which said cylindrical anode is comprised of a wire mesh.

7. A device for producing high-powered and coherent microwaves, as recited in claim 5, in which said cylindrical anode is comprised of a thin metal foil.

8. A method for producing high-powered and coherent microwaves within an evacuated spatial region having a vacuum of about $10^{-5}$ Torr or less, the method comprising the steps of:

rapidly driving a cylindrical and substantially electron-transparent anode, of radius $r_a$, that is internally and co-axially disposed within a cylindrical and hollow real cathode, of radius $r_c$, to a positive potential of $\phi_a-\phi_c$ with respect to the potential of said cylindrical real cathode, thereby causing the field emission of relativistic electrons from said cylindrical real cathode in a generally inward radial direction toward and through said substantially electron-transparent cylindrical anode;

connecting a cylindrical electron collector electrode, of radius $r_{col}$, that is internally and co-axially disposed within said cylindrical and substantially electron-transparent anode, to said cylindrical anode by a short circuit path of low electrical resistance, so that said cylindrical electrode and said cylindrical anode share a common electrical potential during the operation of said device; and selecting the values of $r_c$, $r_a$, $r_{col}$, and $\phi_a-\phi_c$ to satisfy the inequality $$\alpha\left(\frac{r_a}{r_c}\right)^2\left[\frac{\beta(r_{col}/r_a)}{\beta(r_a/r_c)}\right]^2 > 8,$$

wherein $\alpha$ is a relativistic correction factor that is a function of $\phi_a-\phi_c$, and $\beta$ is the Langmuir beta function, so that said field emitted relativistic electrons create a cylindrical virtual cathode that is generally co-axially disposed between said cylindrical anode and said cylindrical electrode, with said high-powered and coherent microwaves being produced by spatial and temporal oscillations of the cylindrical virtual cathode, and by electrons reflexing back and forth between said cylindrical virtual cathode and said cylindrical real cathode.

9. A method for producing high-powered and coherent microwaves as recited in claim 8, further comprising the additional step of fixing the axial length of each of said cylindrical real cathode, said cylindrical anode and said cylindrical electrode, to a value that is approximately equal to the wavelength of the coherent microwaves produced by said method.

10. A method for producing high-powered and coherent microwaves as recited in claim 9, further comprising the additional step of aiding the field emission process by adding a cylindrical velvet inner lining to said cylindrical real cathode.

11. A method for producing high-powered and coherent microwaves as recited in claim 8, in which said rapidly driving step is carried out within a time of three nanoseconds or less.

* * * * *